US009178286B2

(12) United States Patent
Su et al.

(10) Patent No.: US 9,178,286 B2
(45) Date of Patent: Nov. 3, 2015

(54) ANTENNA STRUCTURE FOR MIMO APPLICATION

(71) Applicant: HON HAI PRECISION INDUSTRY CO., LTD., New Taipei (TW)

(72) Inventors: Wei-Cheng Su, New Taipei (TW); Chien-Chang Liu, New Taipei (TW); Yen-Hui Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 187 days.

(21) Appl. No.: 14/062,818

(22) Filed: Oct. 24, 2013

(65) Prior Publication Data

US 2014/0152517 A1 Jun. 5, 2014

(30) Foreign Application Priority Data

Nov. 30, 2012 (TW) ..... 101144870 A

(51) Int. Cl.
*H01Q 21/28* (2006.01)

(52) U.S. Cl.
CPC ..... *H01Q 21/28* (2013.01)

(58) Field of Classification Search
CPC ..... H01Q 13/10; H01Q 21/28
USPC ..... 343/725, 767, 770, 795, 700 MS, 846
See application file for complete search history.

(56) References Cited

U.S. PATENT DOCUMENTS

| | | | | |
|---|---|---|---|---|
| 2004/0070540 | A1* | 4/2004 | Wang et al. | 343/702 |
| 2008/0284670 | A1* | 11/2008 | Kanno et al. | 343/767 |
| 2009/0153411 | A1* | 6/2009 | Chiang et al. | 343/702 |
| 2013/0314293 | A1* | 11/2013 | Wong et al. | 343/848 |

* cited by examiner

*Primary Examiner* — Dameon E Levi
*Assistant Examiner* — Hasan Islam
(74) *Attorney, Agent, or Firm* — Novak Druce Connolly Bove + Quigg LLP

(57) ABSTRACT

An antenna structure for MIMO application includes a substrate, a first antenna element, and a second antenna element. A metal ground layer covers a portion of a first surface of the substrate, and the first antenna element is arranged on the metal ground layer. The first antenna element includes an open-slot, which extending from an edge of the metal ground layer toward an inner portion of the metal ground layer, and a signal feed-in member arranged on a second surface of the substrate and spatially corresponding to an open end of the open-slot. The second antenna element is arranged on the first surface of the substrate adjacent to the first antenna element and extending away from the metal ground layer, and includes a signal feed-in portion arranged adjacent to the open end of the open-slot, and electronically connects to the signal feed-in member.

8 Claims, 2 Drawing Sheets

(a)

(b)

(a)

(b)

ANTENNA STRUCTURE FOR MIMO APPLICATION

BACKGROUND

1. Technical Field

The present disclosure relates to antenna structures, and particularly to an open-slot monopole antenna structure for MIMO application.

2. Description of Related Art

Multiple-input multiple-output (MIMO) communication devices have multiple antenna elements for transmitting and receiving electromagnetic signals. These MIMO communication devices usually have a high speed and a good performance for signal transmission.

However, most existing MIMO antenna structure is composed of multiple antenna elements having a same antenna pattern, such as a multiple monopole antenna or a multiple planar inverted-F antenna (PIFA). Due to the antenna pattern and excitation principle of the multiple antenna elements applied in the MIMO antenna structures being the same, strong mutual inductance coupling is produced when the multiple antennas are arranged close to each other, which interferes with electromagnetic signal transmission, reduces an antenna radiation efficiency, and inhibits generation of diverse far field radiation patterns.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

FIG. 1(*b*) is a cross-sectional view taken along line A-A' of FIG. 1(*a*).

FIG. 2(*b*) is a cross-sectional view taken along line B-B' of FIG. 2(*a*).

DETAILED DESCRIPTION

Figure 1:
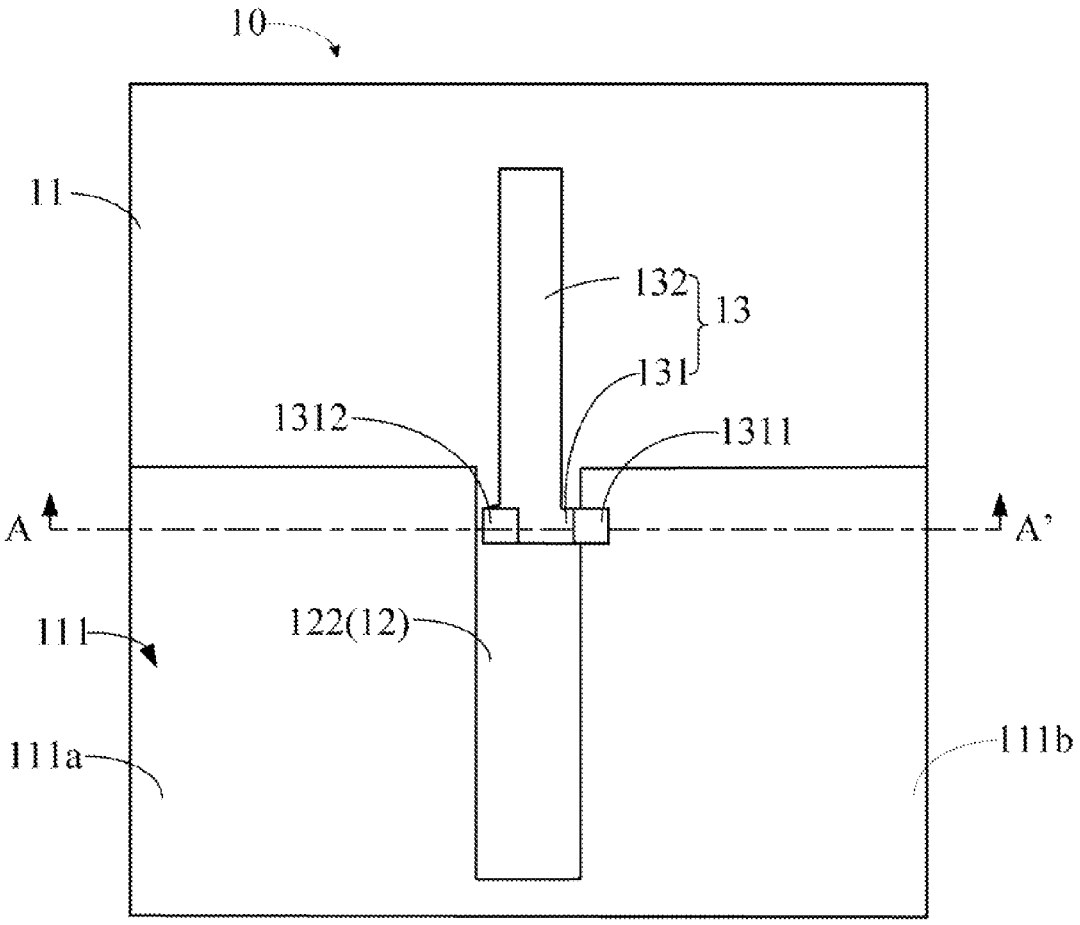
FIG. 1(*a*) is a schematic diagram showing a front view of an antenna structure for a MIMO application, according to an embodiment.
Figure 1:
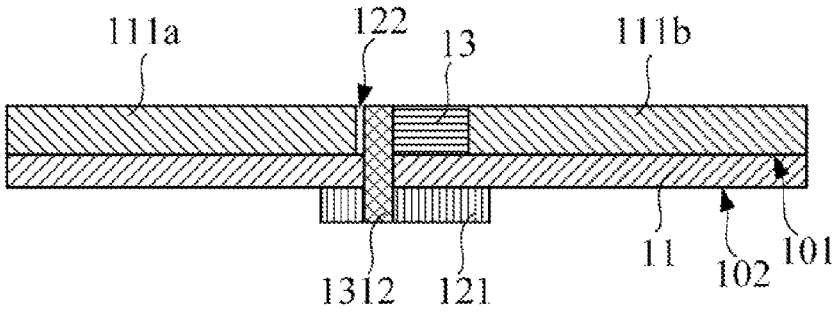

FIG. 1 shows an open-slot monopole antenna structure 10 for a MIMO application of the embodiment. The antenna structure 10 includes a substrate 11, a metal ground layer 111, a first antenna element 12, and a second antenna element 13. The substrate 11 includes a first surface 101 and a second surface 102 opposite to the first surface 101. In the embodiment, the metal ground layer 111 covers a portion of the first surface 101 of the substrate 11, and the first antenna element 12 is arranged on the metal ground layer 111. The second antenna element 13 is arranged on the first surface 101 adjacent to the first antenna element 12 and extends away from the metal ground layer 111. In the embodiment, the first antenna element 12 is an open-slot antenna, and the second antenna element 13 is a monopole antenna.

In the embodiment, the first antenna element 12 includes an open-slot 122, which extends from an edge of the metal ground layer 111 toward an inner portion of the metal ground layer 111, and divides the metal ground layer 111 into a first metal ground layer 111*a* and a second metal ground layer 111*b*. Thus, the open-slot 122 is open at one end adjacent to the edge and closed at the other end at the inner portion.

Figure 2:
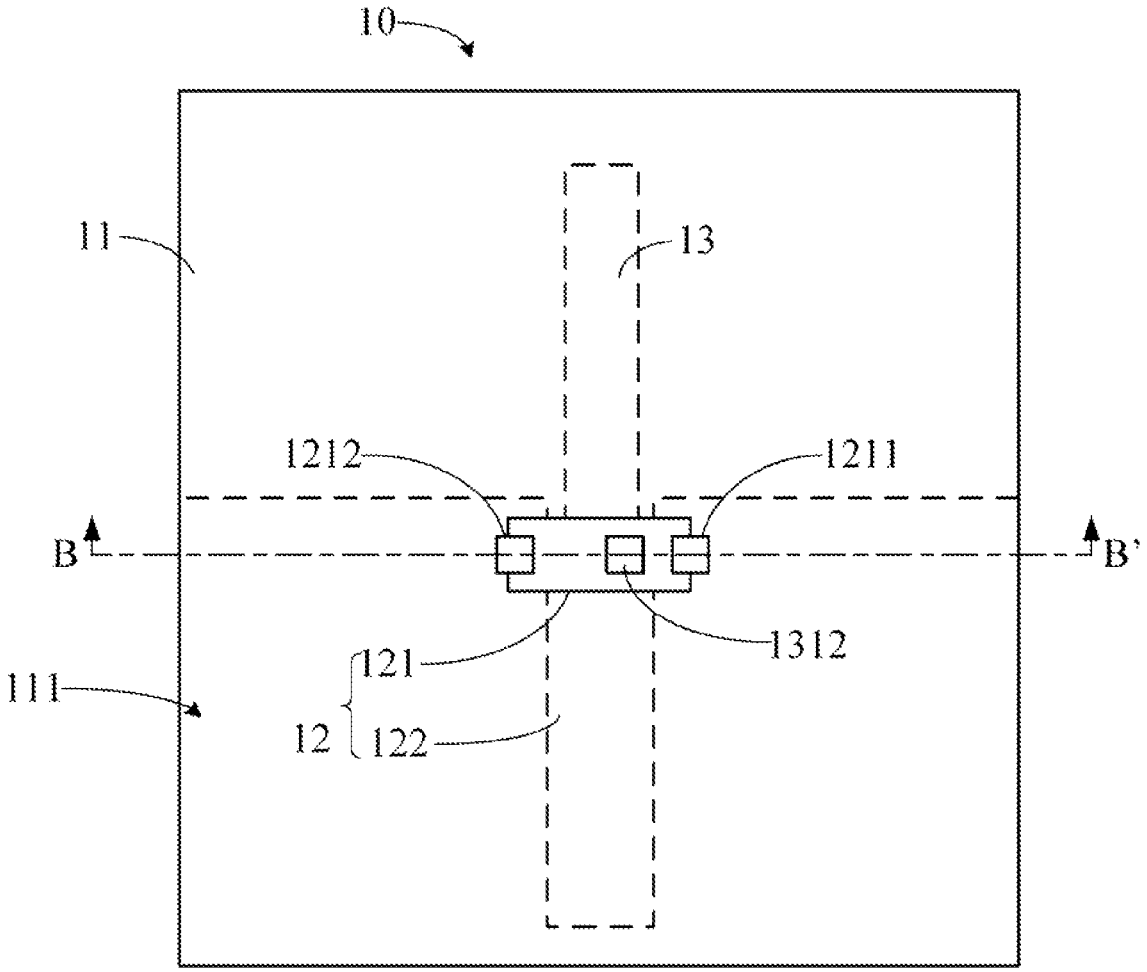
FIG. 2(*a*) is a schematic diagram showing a rear view of the antenna structure of FIG. 1(*a*)
Figure 2:
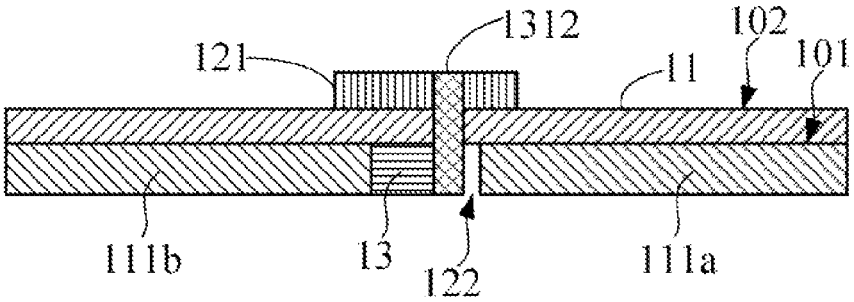

FIG. 2 shows that the first antenna element 12 further includes a signal feed-in member 121, which is arranged on the second surface 102 of the substrate 11 and spatially corresponds to the open end of the open-slot 122. Opposite end portions of the signal feed-in member 121 are mounted on the substrate 11 and spatially correspond to portions of the metal ground layer 111 on opposite sides of the open-slot. In the embodiment, opposite end portions of the signal feed-in member 121 spatially correspond to portions of the first metal ground layer 111*a* and the second metal ground layer 111*b*, respectively. The signal feed-in member 121 is a microstrip line or a coaxial cable.

In the embodiment, the signal feed-in member 121 includes a first signal feed-in point 1211 and an electrical connection point 1212, which are located at two end portions of the signal feed-in member 121, respectively. The electrical connection point 1212 is electronically connected to the metal ground layer 111.

In the embodiment, the first antenna element 12 and the second antenna element 13 are arranged on one single substrate (i.e., the substrate 11). In other embodiments, the first antenna element 12 and the second antenna element 13 are separately arranged on two different substrates.

FIG. 1 also shows that the second antenna element 13 includes a signal feed-in portion 131 and a signal radiation portion 132. The signal feed-in portion 131 is arranged adjacent to the open end of the open-slot 122 and is electrically connected to the signal feed-in member 121.

In the embodiment, the signal feed-in portion 131 includes a second signal feed-in point 1311 and an electrical connection element 1312. The electrical connection element 1312 is configured to electrically connect the signal feed-in portion 131 of the second antenna element 13 to the signal feed-in member 121 of the first antenna element 13 through the substrate 11. The electrical connection element 1312 can be a metal cable, a metal piece, a via-hole, or a coaxial cable, for example.

The signal radiation portion 132 extends along the open-slot 122 from the signal feed-in portion 131 toward a direction away from the metal ground layer 111.

Since the open-slot antenna is excited by a magnetic current principle and the monopole antenna is excited by an electric current principle, the open-slot monopole antenna structure 10 is excited by both magnetic current and electric current principles and can generate diverse antenna patterns having high isolation and low field correlation characteristics and providing an increased speed and a better performance for electromagnetic signal transmission.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. An antenna structure for MIMO application, the antenna structure comprising:

at least one substrate comprising a first surface and a second surface opposite to the first surface;

a metal ground layer covering a portion of the first surface of the substrate;

a first antenna element arranged on the metal ground layer, the first antenna element comprising:

an open-slot extending from an edge of the metal ground layer toward an inner portion of the metal ground layer, wherein the open-slot is open at one end adjacent to the edge and closed at the other end at the inner portion; and a signal feed-in member arranged on the second surface of the substrate and spatially corresponding to the open end of the open-slot, with opposite end portions thereof being mounted on the substrate and respectively spatially corresponding to portions of the metal ground layer on opposite sides of the open-slot; and a second antenna element arranged on the first surface adjacent to the first antenna element and extending away from the metal ground layer, the second antenna element comprising:

a signal feed-in portion arranged adjacent to the open end of the open-slot and electronically connected to the signal feed-in member; and a signal radiation portion extending along the open-slot from the signal feed-in portion toward a direction away from the metal ground layer.

2. The antenna structure as described in claim 1, wherein the signal feed-in member comprises an electrical connection point and a first signal feed-in point, which are located at two end portions of the signal feed-in member, respectively, wherein the electrical connection point is electronically connected to the metal ground layer.

3. The antenna structure as described in claim 2, wherein the signal feed-in portion comprises a second signal feed-in point and an electrical connection element, wherein the electrical connection element is configured to electronically connect the signal feed-in portion of the second antenna element to the signal feed-in member of the first antenna element through the substrate.

4. The antenna structure as described in claim 3, wherein the at least one substrate is one substrate.

5. The antenna structure as described in claim 3, wherein the at least one substrate comprises two substrates, and the first antenna element and the second antenna element are separately arranged on the respective substrates.

6. The antenna structure as described in claim 1, wherein the signal feed-in member is selected from a group consisting of a microstrip line and a coaxial cable.

7. The antenna structure as described in claim 3, wherein the electrical connection element is selected from a group consisting of a metal cable, a metal piece, a via-hole, and a coaxial cable.

8. The antenna structure as described in claim 1, wherein the first antenna element is an open-slot antenna, and the second antenna element is a monopole antenna.

* * * * *